United States Patent [19]

Rejai

[11] 4,065,122

[45] Dec. 27, 1977

[54] EMERGENCY BRAKE FOR MOVABLE CONVEYOR

[75] Inventor: Jamshid Rejai, Lindenwold, N.J.

[73] Assignee: Molins Machine Company, Inc., Cherry Hill, N.J.

[21] Appl. No.: 705,191

[22] Filed: July 14, 1976

[51] Int. Cl.[2] ..... B65H 29/50

[52] U.S. Cl. ..... 271/201; 187/87; 214/6 G; 271/217

[58] Field of Search ..... 271/201, 217; 187/87; 214/6 G

[56] References Cited

U.S. PATENT DOCUMENTS

| | | | |
|---|---|---|---|
| 1,039,073 | 9/1912 | Tessmer | 187/87 |
| 1,141,277 | 6/1915 | Smith | 271/201 X |
| 1,396,752 | 11/1921 | Hoffer | 187/87 |
| 3,030,107 | 4/1962 | Stidwill | 271/201 X |
| 3,297,318 | 1/1967 | Knecht | 271/201 |

*Primary Examiner*—Bruce H. Stoner, Jr.
*Attorney, Agent, or Firm*—Seidel, Gonda & Goldhammer

[57] ABSTRACT

At least one end of a conveyor having guided movement in an upright direction is provided with an emergency brake to stop descent of the conveyor in the event of a component failure. The brake includes elements on the conveyor which cooperate with the conveyor guide.

4 Claims, 5 Drawing Figures

FIG. 3
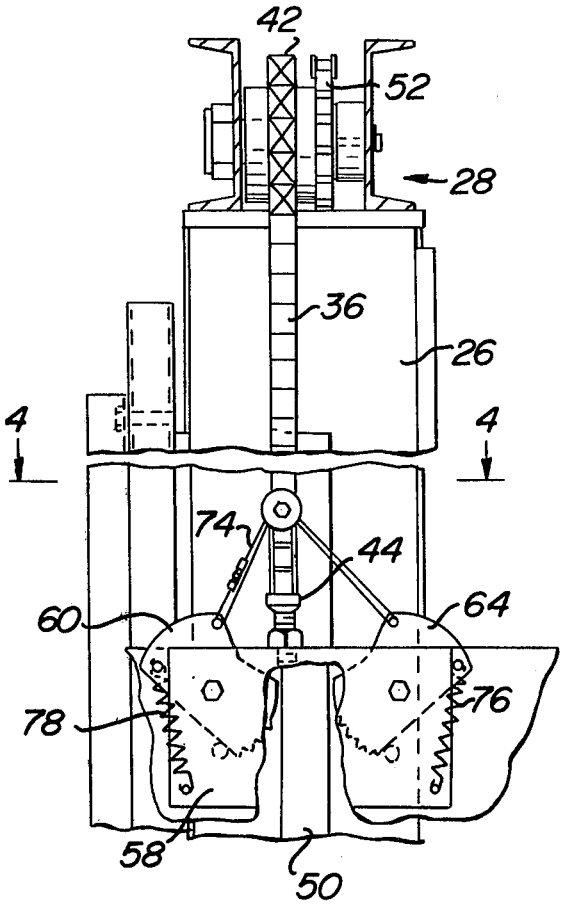
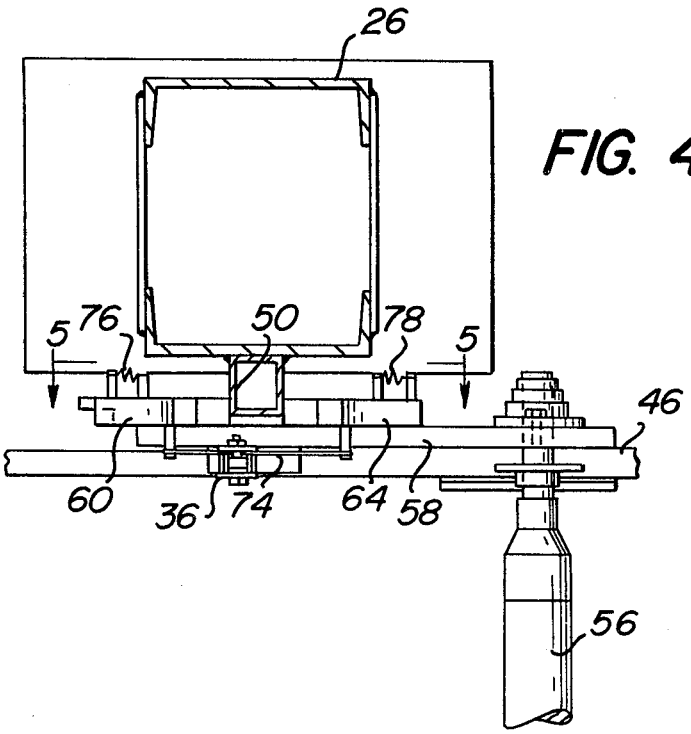
FIG. 4

EMERGENCY BRAKE FOR MOVABLE CONVEYOR

BACKGROUND

The present invention relates broadly to conveyors, and more particularly, to sheet stacking conveyors which have at least one end which moves in an upright direction in connection with the deposit of sheets in overlying relationship to form a stack. A number of such conveyors have been described in the patent literature. For example, see U.S. Pat. Nos. 2,660,432; 2,901,250; and 3,658,322.

In the processing of rigid sheets, such as sheets of corrugated paperboard, it is conventional to move the sheets on a conveyor from a sheet forming machine to a palletized stack for subsequent operations. In forming said stack, a stacking conveyor ejects the sheets sequentially one upon the other while the discharge end of the stacking conveyor rises in synchronism with the increase in height of the stack.

It is common for such stacks to reach a height of 6 feet or more. The discharge end of the stacking conveyor may rise to a height greater than the height of a workman. If a workman happened to be under the discharge end of the stacking conveyor at a moment when a chain or other component of the supporting structure failed, the falling conveyor might cause injury to the workman. Accordingly, there is a need for a device to prevent such conveyors from accidentally dropping and yet not interfere with operation of the conveyor.

SUMMARY OF THE INVENTION

The apparatus of the present invention includes a conveyor having a discharge end guided for movement in an upright direction by an upright guide. A power means is connected to the conveyor for moving the conveyor discharge end vertically. A brake means is provided on the conveyor adjacent the discharge end and is constructed for movement into contact with said guide for arresting accidental descent of the conveyor discharge end upon a failure of a portion of said power means.

It is an object of the present invention to provide a safe conveyor having a discharge end which moves vertically by providing a brake which performs its intended function without interferring with normal operation of the conveyor.

It is another object of the present invention to provide a stacking conveyor with a simple, reliable and inexpensive emergency brake to prevent accidental descent of the conveyor.

Other objects will appear hereinafter.

For the purpose of illustrating the invention, there is shown in the drawings a form which is presently preferred, it being understood, however, that this invention is not limited to the precise arrangements and instrumentalities shown.

FIG. 3 is a sectional view taken along the line 3—3 in FIG. 2.

FIG. 4 is a sectional view taken along the line 4—4 in FIG. 3.

Figure 1:
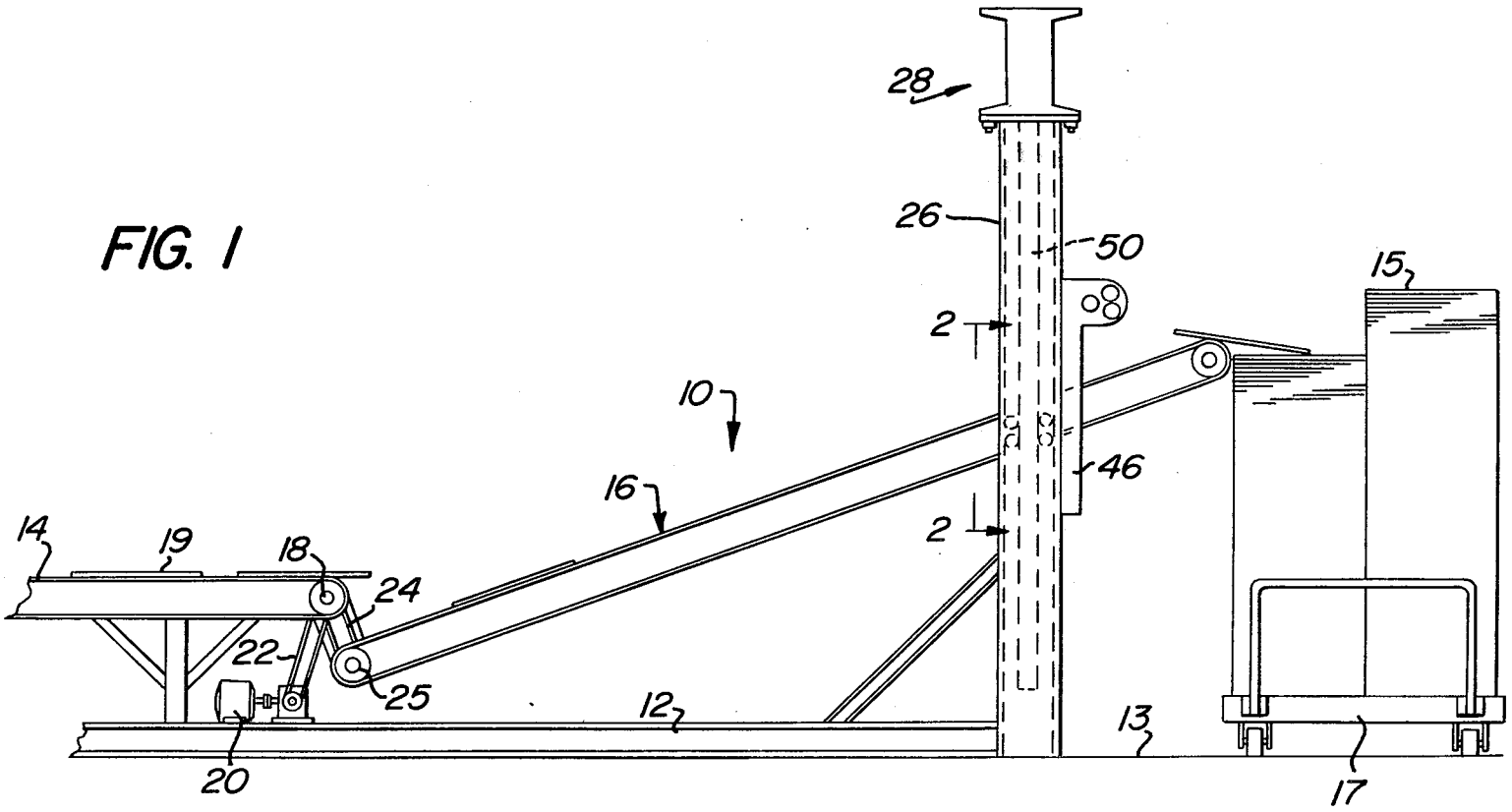
FIG. 1 is a side elevation view of apparatus in accordance with the present invention.

Referring to the drawing in detail, wherein like numerals indicate like elements, there is shown in FIG. 1 a stacking conveyor designated generally as 10. The conveyor 10 includes a horizontally disposed base 12 resting on the floor 13. The apparatus 10 may be utilized to form a stack of sheets 15 on the vehicle or other conveyor 17.

The apparatus 10 includes a first conveyor 14 which feeds sheets 19 in single or fanned orientation to the stacking conveyor 16. A motor is provided for driving the conveyors 14 and 16 in synchronism. Motor 20 is coupled to roller 18 by way of a chain or belt 22. Roller 18 is connected by way of a chain or belt 24 to a roller 25 at the input end of the stacking conveyor 16. Hence, both conveyors 14 and 16 are driven by motor 20. If desired, independent synchronized motors may be utilized.

In FIG. 1, the discharge end of the conveyor 16 is the righthand end. The discharge end of conveyor 16 is mounted for vertical movement between a pair of identical vertical standards 26. Only one standard 26 is shown. The standards 26 are innerconnected at their upper end by a bridge 28.

Figure 2:
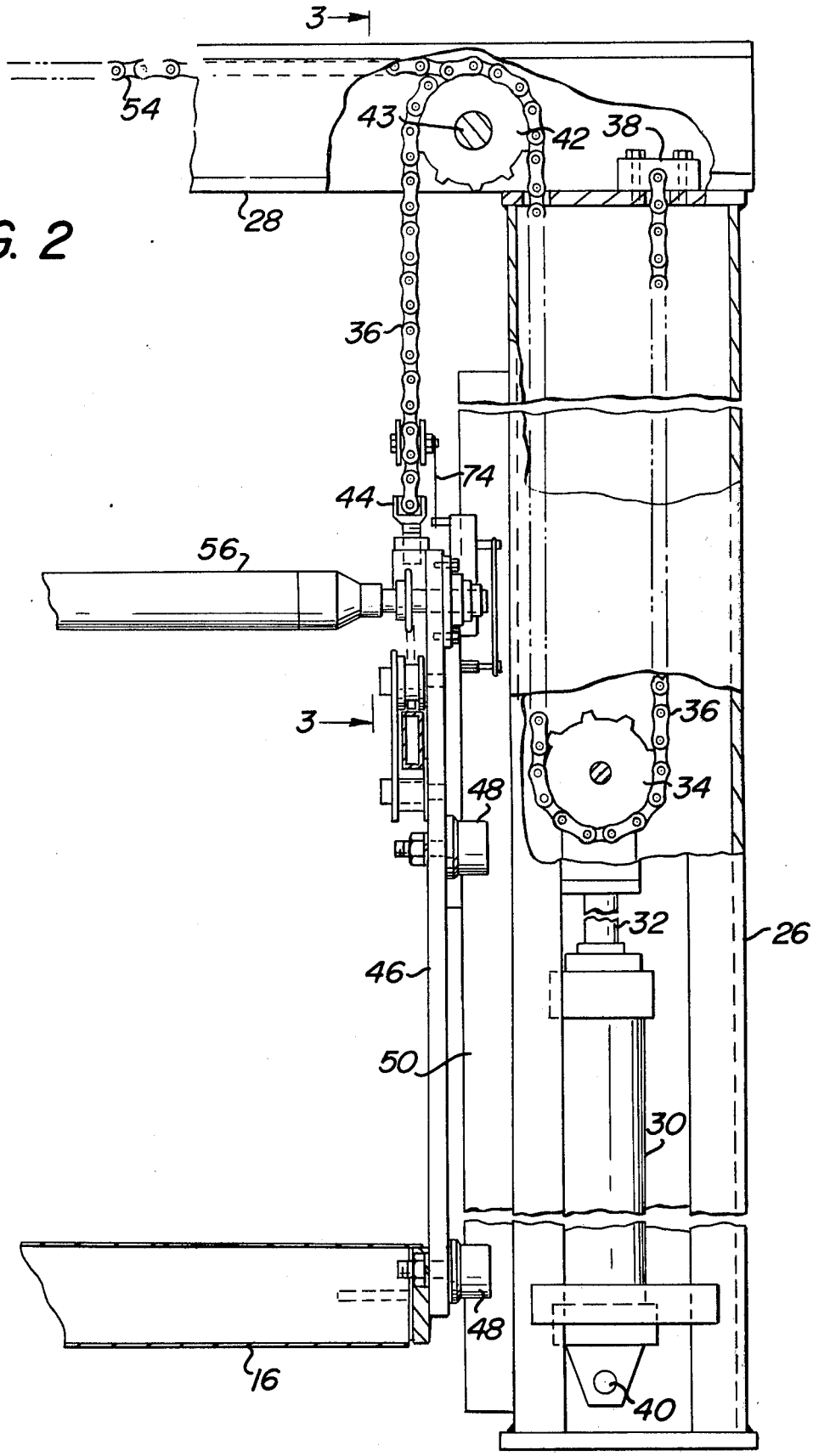
FIG. 2 is a view taken along the line 2—2 in FIG. 1.

Referring to FIG. 2, a power means is provided to raise and lower the discharge end of the conveyor 16. It will be noted that the standard 26 is hollow and that a cylinder 30 is provided therewithin. Cylinder 30 has a piston rod 32 connected to a sprocket 34. One end of a chain or cable 36 is fixedly connected to a anchor 38.

The chain 36 extends downwardly around the sprocket 34 and then upwardly to a second sprocket 42 rotatably supported by shaft 43. From sprocket 42, the chain 36 extends downwardly to a bolt 44 or an equivalent device on a carriage 46.

The carriage 46, preferably in the form of a plate, is provided with sets of guide rollers 48 on opposite sides of a vertically disposed track 50. Track 50 is connected to the standard 26. Track 50 may desirably be simple and inexpensive channel 50 welded to the standard 26. In order that the power means shown in FIG. 2 and its mating power means on the opposite side of the conveyor 16 may be synchronized, a sprocket 52 on shaft 43 is coupled to a comparable shaft and sprocket near the opposite end of bridge 28 by way of a chain 54. Further, a cross bar 56 rigidly interconnects carriage 46 in FIG. 2 with the mating carriage on the opposite side of the conveyor 16.

Figure 5:
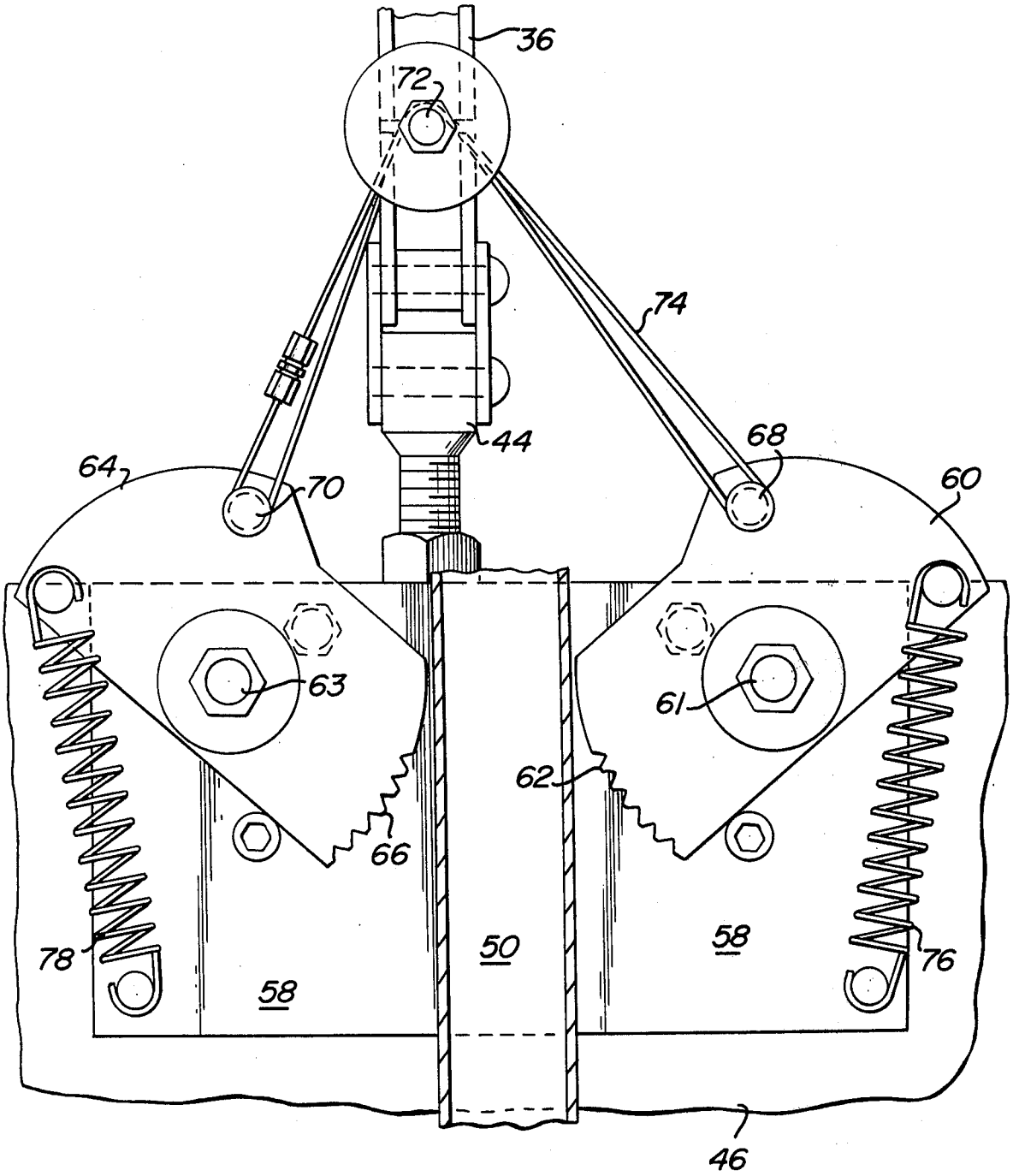
FIG. 5 is an enlarged view of the brake means taken along the line 5—5 in FIG. 4.

Referring to FIG. 5, a mounting plate 58 is bolted or otherwise secured to the carriage 46 on a surface of the carriage facing the standard 26. A jaw 60 is pivotably secured to plate 58 by pin 61. A jaw 64 is pivotably secured to the plate 58 by pin 63. The jaws 60, 64 are spaced from one another by a gap so as to accommodate the guide 50 therebetween. Jaw 60 terminates in a serrated tip portion 62. Jaw 64 terminates in a serrated tip portion 66.

A pin 68 is provided at a remote end of the jaw 60. A pin 70 is provided at a remote end of the jaw 64. A jam nut 72 is provided adjacent the lower end of the chain 36 immediately adjacent the bolt 44. A wire rope 74 or similar device in the form of a loop extends around the pins 68, 70 and jam nut 72 to maintain the jaws 60, 64 in the disposition shown in FIG. 5. A coil spring 76 has one end connected to a remote end portion of the jaw 60 and has its other end connected to a pin on plate 58. Jaw 64 is similarly coupled to plate 58 by way of spring 78. The springs 76 and 78 tend to bias the jaws 60, 64 into contact with the opposite side faces of the guide 50 but are not permitted to do so because of the loop of wire rope 74. If the chain 36 breaks or is otherwise slack, the loop 74 will collapse and springs 76, 78 will pivot the jaws 60, 64 into contact with the guide 50. The serrated portions 62, 66 assure that the jaws will have biting contact and immediately arrest any descent of the carriages 46 on opposite sides of the conveyor 16.

As shown more clearly at the lower end of FIG. 2, the lower end of each of the carriages 46 are pivotably connected to a side plate of the conveyor 16 by way of a sliding connection so that the discharge end of the conveyor 16 will move vertically to facilitate proper stacking of the stack 15. If desired, auxiliary equipment such as a striker plate or the like may be suspended from the carriages 46 in a conventional manner.

The operation of the apparatus 10 will be apparent to those skilled in the art in view of the above description and attached drawings. In a conventional manner, the input end of conveyor 16 moves toward and away from the standards 26 as the discharge end of the conveyor 16 ascends or descends. To cause the discharge end of the conveyor 16 to ascend, the piston rod 32 associated with the cylinder 30 in each of the standards 26 moves downwardly to increase the size of the loop of chain 36 within the standard 26. The reverse is true when it is desired to permit the discharge end of the conveyor 16 to descend.

The discharge end of the conveyor 16 is caused to ascend or descend intermittently as a function of the height of the stack 15. Conventional apparatus not shown, such as photoelectric cell, is utilized to intermittently operate the power means. If the discharge end of conveyor 16 is in an elevated position, a workman disposed beneath the discharge of the conveyor 16 could be severely injured in the event of a failure of any portion of the power means. Typically, such failure would occur by a break in the chain 36.

If the chain 36 is broken, the tension of wire rope 74 is immediately released whereby springs 76 and 78 are no longer restrained. Contraction of such springs pivots the jaws 60, 64 about their respective pivot pins into interference contact with opposite side walls of the guide 50 and thereby halt descent of the discharge end of the conveyor 16. It will be noted that actuation of the jaws 60, 64 is automatic whereby intermediate switches or the like are eliminated.

The arcuate serrated portions 62, 66 of the jaws 60, 64 are eccentric with respect to the pivot pins 61, 63. In place of the springs 76, 78, counterweights may be provided. The jaws 60, 64 will brake the descent of the discharge end of conveyor 16 under circumstances other than breakage of the chain 36. For example, the wire rope 74 will become slack in the event that there is a lack of tension in chain 36 due to a failure of the hydraulic motive fluid introduced into the cylinders 30.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a stacking conveyor having a discharge end, at least one carriage supporting said conveyor discharge end for straight vertical movement, a standard adjacent the discharge end of said conveyor, a vertical guide for guiding vertical movement of said carriage, said vertical guide being attached to said standard, power means for moving said carriage along said guide, said power means including a chain connected to said carriage, said carriage including a plate member extending between and interconnecting said chain with said discharge end of said conveyor, at least one pair of guide rollers carried by said plate member, one roller of a pair contacting one vertical surface of said guide and the other roller of a pair contacting another vertical surface of said guide, an emergency brake on said plate member for cooperation with said guide to stop descent of said carriage and conveyor in the event that said chain is not under tension, said brake means including a pair of members pivotably mounted on said carriage on opposite sides of said guide and biased toward said guide, restraining means for preventing contact between said guide and brake members, said restraining means including a loop of wire coupled to each brake member and to said chain, said restraining means being responsive to tension in the chain whereby contact between the brake member and said guide is prevented when said chain is under tension, and said plate member being attached to a first end of said chain, a second end of said chain being attached to said standard, said chain being received about first and second rotatable sprockets, said first sprocket being movable in a vertical direction and said second sprocket being rotatable about a fixed axis and said power means includes a hydraulic cylinder having a movable piston connected to said first sprocket.

2. Sheet stacking apparatus comprising a stacking conveyor adapted to receive sheets and discharge the same from one end thereof sequentially to form a vertical stack, a standard adjacent the discharge end of said conveyor, the discharge end of said conveyor being coupled to a first end of a chain, a second end of said chain being attached to said standard, said chain being received about first and second rotatable sprockets, said second sprocket being rotatable about a fixed axis and said first sprocket being movable in a vertical direction, power means for lowering said first sprocket and for thereby raising the discharge end of said conveyor in synchronism with increase in the height of the stack, a vertical guide for the discharge end of the conveyor as it is moved vertically, braking means adjacent the discharge end of the conveyor for potential engagement with said guide to arrest accidental descent of the discharge end of said conveyor, restraining means for preventing engagement of said braking means with said guide while said chain is under tension, said restraining means being coupled between said braking means and said chain, and biasing means for urging said braking means toward engagement with said guide when said restraining means is ineffective.

3. Sheet stacking apparatus in accordance with claim 2 wherein said chain extends generally upwardly from its first end to said second sprocket and thereafter generally downwardly to said vertically movable first sprocket and thereafter upwardly to its point of attachment to said standard and said power means includes a hydraulic cylinder with a movable piston rod connected to said first sprocket.

4. Sheet stacking apparatus in accordance with claim 2 wherein said braking means includes a pair of brake members being pivotable toward and away from said guide, and said restraining means includes a loop of flexible material coupled to each brake member and to said chains.

* * * * *